US008857617B2

(12) United States Patent
Balakier et al.

(10) Patent No.: US 8,857,617 B2
(45) Date of Patent: Oct. 14, 2014

(54) MEDICINE DISPENSER WITH BUILT-IN DISPENSING SCHEDULE

(75) Inventors: Alfred Richard Balakier, Kirkland, WA (US); Dan Gosselin, Gloucester, MA (US)

(73) Assignee: Red Cap LLC, Marble Head, MA (US)

( * ) Notice: Subject to any disclaimer, the term of this patent is extended or adjusted under 35 U.S.C. 154(b) by 293 days.

(21) Appl. No.: 13/110,870

(22) Filed: May 18, 2011

(65) Prior Publication Data

US 2011/0284415 A1 Nov. 24, 2011

Related U.S. Application Data

(60) Provisional application No. 61/395,939, filed on May 18, 2010.

(51) Int. Cl.

| | |
|---|---|
| ***B65D 83/04*** | (2006.01) |
| ***B65D 50/04*** | (2006.01) |
| ***A61J 7/04*** | (2006.01) |
| ***B65D 41/06*** | (2006.01) |
| *A61J 1/03* | (2006.01) |

(52) U.S. Cl.

CPC ..... *B65D 41/06* (2013.01); *B65D 2251/04* (2013.01); *B65D 50/04* (2013.01); *A61J 7/04* (2013.01); *A61J 1/03* (2013.01)

USPC ..... 206/528; 206/540

(58) Field of Classification Search

USPC ..... 116/308, 309, 311, 312, 315; 206/459.1, 528, 540; 215/201, 202

See application file for complete search history.

(56) References Cited

U.S. PATENT DOCUMENTS

| | | | |
|---|---|---|---|
| 3,151,599 | A | 10/1964 | Livingston |
| 4,011,829 | A | 3/1977 | Wachsmann et al. |
| 4,419,016 | A | 12/1983 | Zoltan |
| 4,432,300 | A | 2/1984 | Lyss |
| 4,489,834 | A | 12/1984 | Thackrey |
| 4,501,370 | A | 2/1985 | Kelley |
| 4,572,376 | A | 2/1986 | Wrennall |
| 4,634,012 | A | 1/1987 | Kelley |
| 4,641,759 | A | 2/1987 | Kelley |
| 4,646,936 | A | 3/1987 | Frazier et al. |
| 4,666,051 | A | 5/1987 | Trick |
| 4,723,673 | A | 2/1988 | Tartaglia et al. |

(Continued)

FOREIGN PATENT DOCUMENTS

| | | |
|---|---|---|
| JP | 07-299124 | 11/1995 |
| JP | 2001-206463 | 7/2001 |

*Primary Examiner* — Anthony Stashick
*Assistant Examiner* — Kaushikkumar Desai
(74) *Attorney, Agent, or Firm* — Olympic Patent Works, PLLC

(57) ABSTRACT

One embodiment of the present invention is a medicine dispenser with a built-in dispensing schedule. In this embodiment, a cylindrical container with a close-fitting disk-shaped cap having a cylindrical rim includes an inner schedule display, one day-and-time indication of which is displayed to a medicine consumer through an aperture in the cap rim. Features included in the cap, schedule display, and cylindrical container interoperates to ensure that the displayed day-and-time indication is advanced when the cap is removed and replaced. The displayed day-and-time indication is relatively large and clear, to facilitate viewing by vision-impaired users, and the schedule-advancement mechanism is robust and reliable. In addition, the cap and built-in schedule display include features that allow the displayed day-and-time indication to be set to an initial day-and-time indication.

20 Claims, 7 Drawing Sheets

(56) References Cited

U.S. PATENT DOCUMENTS

| | | | | | |
|---|---|---|---|---|---|
| 4,753,189 | A | * | 6/1988 | Mastman et al. | 116/308 |
| 4,756,423 | A | | 7/1988 | Holtsch | |
| 4,782,966 | A | * | 11/1988 | Thackrey | 215/230 |
| 4,951,596 | A | | 8/1990 | Wallace, Jr. | |
| 5,009,338 | A | | 4/1991 | Barker | |
| 5,082,129 | A | * | 1/1992 | Kramer | 215/221 |
| 5,271,353 | A | | 12/1993 | Besthorne | |
| 5,433,324 | A | | 7/1995 | Leonard | |
| 5,520,307 | A | | 5/1996 | Miller et al. | |
| 5,662,224 | A | | 9/1997 | Nogues | |
| 5,694,882 | A | | 12/1997 | Marshall | |
| 6,003,467 | A | | 12/1999 | Shelton-Ferrell et al. | |
| 6,152,067 | A | | 11/2000 | Mathison | |
| 6,667,936 | B1 | | 12/2003 | Ditzig | |
| 7,017,762 | B2 | | 3/2006 | Shane | |
| 2005/0205595 | A1 | | 9/2005 | Lepke et al. | |
| 2008/0099423 | A1 | * | 5/2008 | Koch | 215/230 |

* cited by examiner

MEDICINE DISPENSER WITH BUILT-IN DISPENSING SCHEDULE

CROSS-REFERENCE

This application claims the benefit of Provisional Patent Application No. 61/395,939, filed May 18, 2010.

TECHNICAL FIELD

The present invention is related to medicine dispensers, including pill bottles, and, in particular, to a medicine dispenser with a built-in dispensing schedule that indicates when a next dose is to be administered according to the built-in schedule.

BACKGROUND

Failure to adhere to a prescribed medication dosage regimen is a dangerous and ubiquitous problem. Missing a prescribed dosage of certain medications, such as blood-pressure medicine, may result in significant harm and even death. Accidental overdose of prescription medication is likely to cause negative effects that are more dangerous than missing a prescribed dosage.

According to the National Council on Patient Information, up to 60% of all prescribed medication is taken incorrectly. Physicians themselves take only 75% of prescribed pills correctly. Non-compliance costs more than $300 billion a year in the USA, accounts for 13% of all hospital admissions, and causes 300,000 deaths.

One difficult aspect of adhering to a prescribed medication regimen for many patients is not remembering to take medication, but rather trying to decipher whether or not one has already taken a particular dose. The repetitive nature of consuming medication on a daily basis can lead to confusion, in patients self-administering the medicine, with regard to whether or not the last dose or one of a number of doses that were scheduled for administration have, in fact, been taken.

Many different medicine-administration regimes and dispensers have been proposed and developed in order to assist patients in self-administration of prescription medicines. However, the fact that, according to current statistics, non-compliance with administration schedules continues to be a serious problem and represents a significant financial burden to patients and to society indicates that the many proposed and currently-available regimes and dispensers have not effectively addressed problems associated with self-administration of medicines by medicine consumers.

SUMMARY

One embodiment of the present invention is a medicine dispenser with a built-in dispensing schedule. In this embodiment, a cylindrical container with a close-fitting disk-shaped cap having a cylindrical rim includes an inner schedule display, one day-and-time indication of which is displayed to a medicine consumer through an aperture in the cap rim. Features included in the cap, schedule display, and cylindrical container interoperates to ensure that the displayed day-and-time indication is advanced when the cap is removed and replaced. The displayed day-and-time indication is relatively large and clear, to facilitate viewing by vision-impaired users, and the schedule-advancement mechanism is robust and reliable. In addition, the cap and built-in schedule display include features that allow the displayed day-and-time indication to be set to an initial day-and-time indication.

DETAILED DESCRIPTION

Embodiments of the present invention are directed to medicine dispensers, including pill-bottle-like medicine dispensers, that feature secure child-proof containment of medicines within the medicine dispenser as well as a robust and reliable mechanism for display of an indication of the time and day when a next dose needs to be administered to, or self-administered by, a medicine consumer, such as a patient in a health-care facility or an outpatient. Unlike currently-available medicine dispensers and medication-dispensing regimes, embodiments of the present invention feature relatively large, easy-to-read indications for time and day of next administration of a dose from the medicine dispenser as well as reliable advancement of the displayed time-and-day indication within the built-in medicine-dispensing schedule. In addition, the built-in dispensing schedule can be initially set to an arbitrary one of the multiple indications included in the built-in dispensing schedule.

Figure 1:
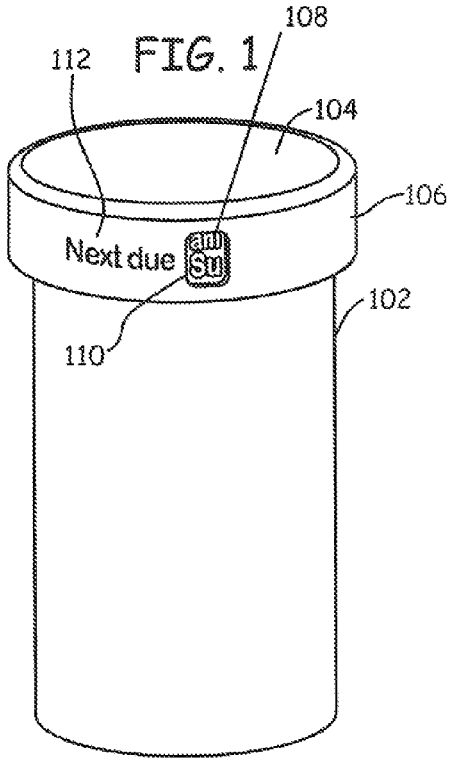
FIG. 1 is a perspective view of one embodiment of the present invention.

FIG. 1 is a perspective view of one embodiment of the present invention. The illustrated embodiment resembles a standard plastic pill bottle that includes a cylindrical container 102 and a disk-shaped cap 104, the plane of which is orthogonal to the long axis of the cylindrical container 102 when affixed to the cylindrical container. The cap includes a cylindrical rim 106 of larger inner diameter than the diameter of the cylindrical container 102 with a schedule-display component, discussed below, mounted within. A single indication, or schedule element 108, is displayed to a user through a rectangular aperture 110 in the cylindrical cap rim 106. In the example embodiment shown in FIG. 1, the schedule element includes an indication of the time of day, "am," and an indication of the day of the week, "Su," when a next dose is to be administered to, or self-administered by, a medicine consumer. In the example shown in FIG. 1, the label "Next due" 112 is imprinted on the cap rim 106 as further indication that the displayed indications of a time and day of the week indicate a next time and day when a next dose is to be administered to, or self-administered by, the medicine consumer.

Interior features of the cap, inner schedule display, and container interoperate to ensure that displayed indication is advanced by one element with respect to the schedule display when the cap is removed and re-affixed to the container. The display indication is not advanced with respect to the built-in schedule unless the cap is successfully removed and replaced. Please note that, unlike in many currently-available devices, the displayed indication is displayed from the cap rim, ensuring that there is adequate available area to display a clear and easily read indication. Please also note that the particular form of the indication for when a next dose is to be administered or self-administered may vary with different embodiments of the present invention. In certain cases, the indication may include a particular hour and day of the week. In alternative embodiments, the indication may only display a day of the week. In yet further embodiments, the indication may display precise time and/or date information. The built-in schedule may include an essentially arbitrary number of different elements, or indications. In the example embodiment discussed in the current application, the built-in schedule display includes 14 elements that include morning and evening administration times for each of the seven days of the week.

The medicine container and dispenser shown in FIG. 1 that represent one embodiment of the present invention can be inexpensively manufactured from commonly used polymeric materials. When manufactured according to currently-available precision, the three interoperating components of the example medicine-dispenser embodiment provide for reliable advancement of the displayed schedule elements by one position only when the cap is successfully removed and reaffixed to the cylindrical container. Embodiments of the present invention are designed for rapid, reliable, and cost-efficient mass-manufacturing. Each of the three components, including the cap 104, schedule-display 202, and cylindrical container 102 is shaped so that it can be quickly released from a mold.

Figure 2:
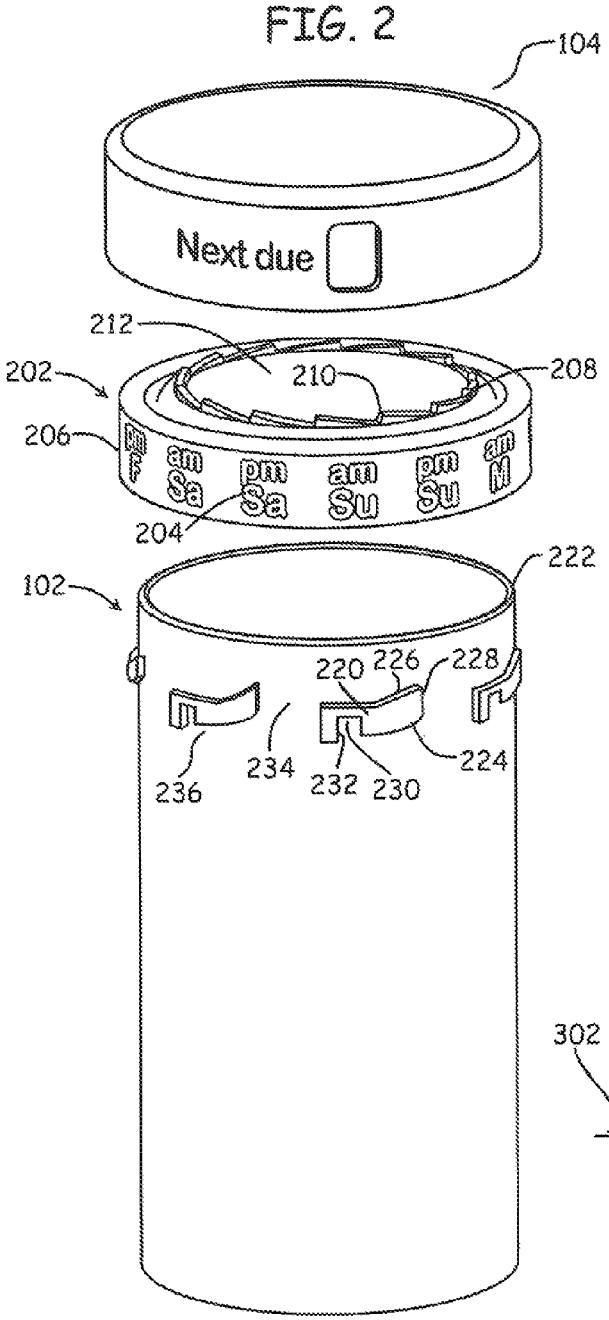
FIG. 2 is an enlarged exploded perspective of the embodiment of the present invention shown in FIG. 1.

FIG. 2 is an enlarged exploded perspective of the embodiment of the present invention shown in FIG. 1. In the exploded view, the three components of the example medicine-dispenser embodiment shown in FIG. 1 are clearly visible, as well as additional features of two of the three components. The cylindrical, built-in schedule display 202 is shown disassembled from and below the cap 104. As can be more clearly seen in FIG. 2, the built-in schedule display includes 14 time-of-day and day-of-week elements or indications, such as the "pm/Sa" indication 204 from among 6 of the 14 schedule elements, or indications, included along the outer cylindrical wall, or display surface, 206 of the schedule display. The built-in schedule display also includes a schedule-display ratchet wheel 208 and a disk-like surface 212 orthogonal to the axis of the cylindrical wall 206. On the outer surface of the cylindrical container 102, seven boss features, including boss feature 220, extend outward from the outer surface of the cylindrical container. The boss features are uniformly spaced along the circumference of the cylinder positioned at a uniform position with respect to the lip 222 of the cylindrical container 102. Each boss feature includes a cam surface 224, a ramp portion 226, a leading edge 228, a lug notch 230, and a stop portion 232. There is a significant space between each pair of boss features along the circumference of the cylinder, such as space 234 between boss 220 and preceding boss 236.

Figure 3:
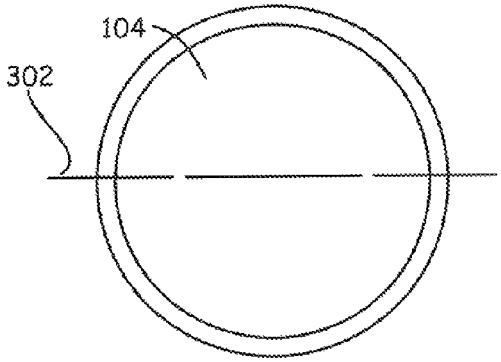
FIG. 3 is a top plan view of the embodiment of the present invention shown in FIG. 1.

FIG. 3 is a top plan view of the embodiment of the present invention shown in FIG. 1. As can be seen in FIG. 3, the cap is circular in projection orthogonal to the plane of the disk-shaped cap. Line 302 in FIG. 3 indicates the intersection of a plane orthogonal to the disk-shaped surface of the cap with the cap that defines a cross-section view of the example medicine-dispenser embodiment shown in FIG. 7.

Figure 4:
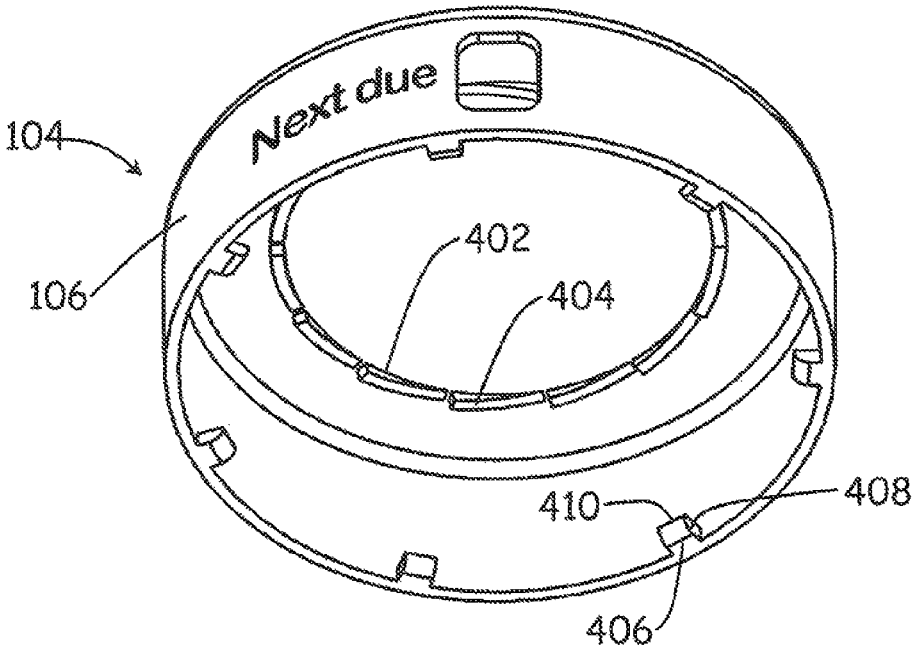
FIG. 4 is a perspective view of the cap of the embodiment of the present invention shown in FIG. 1.

FIG. 4 is a perspective view of the cap of the embodiment of the present invention shown in FIG. 1. In FIG. 4, the cap component is viewed from below. As can be seen in FIG. 4, the cap includes a cap ratchet wheel 402 with ratchet teeth, such as ratchet tooth 404 that protrude downward, orthogonal to the plane of the disk-shaped cap and parallel to the cylindrical cap rim 106. The cap ratchet wheel is complementary to the schedule-display ratchet wheel (208 in FIG. 2). At the base of the cap rim, seven lugs, such as lug 406, uniformly spaced along the bottom edge of the cap rim, protrude inward in radial directions from the inner surface of the cap rim. Each lug features a leading side 408 and an inside edge 410. In the example embodiment shown in FIGS. 1-4, there are seven uniformly spaced lugs complementary to the spacings between the seven boss features (220 and 236 in FIG. 2) of the cylindrical container 102. There are 14 ratchet teeth in both the cap ratchet wheel 402 and the schedule-display ratchet wheel (208 in FIG. 2). These various features interoperate, together with the features described below, to provide both child-proof locking of the cap to the cylindrical container as well as to provide for reliable advancement of the displayed schedule element by one element with each successful removal and replacement of the cap.

Figure 5:
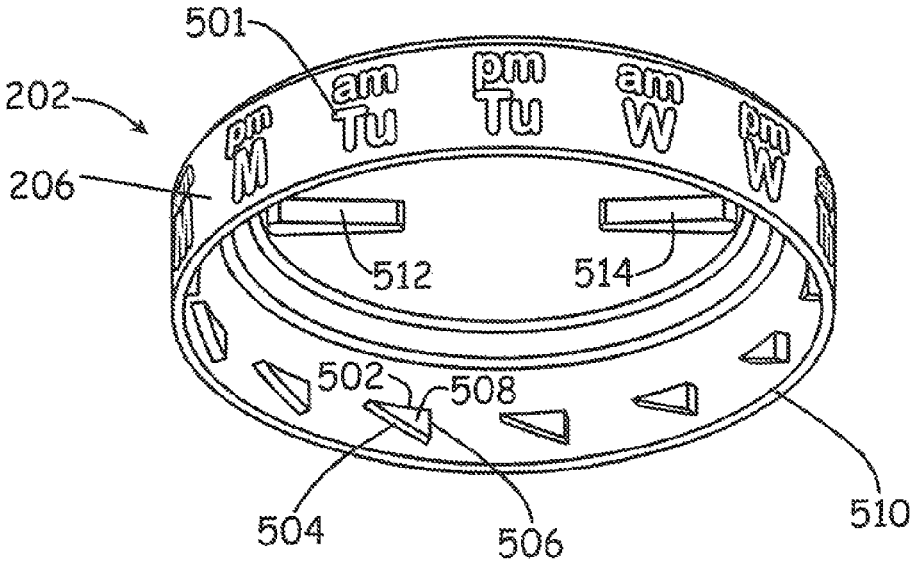
FIG. 5 is a perspective view of the schedule display from the embodiment of the present invention shown in FIG. 1.

FIG. 5 is a perspective view of the schedule display from the embodiment of the present invention shown in FIG. 1. In FIG. 5, the built-in schedule display 202 is shown from underneath. In addition to the schedule elements uniformly spaced on the display surface of the built-in schedule display 206, such as schedule element 208 204, the built-in schedule display additionally includes 14 triangular biasing features, such as biasing feature 502 that extend inward, in radial directions, from the inner surface of the cylindrical wall of the built-in schedule display. Each biasing feature includes a lower sliding surface 504, an abutment surface 506, and an inner side 508. As discussed below, the biasing features interoperate with the boss features (220 and 236 in FIG. 2) that extend from the outer surface of the cylindrical container 102 in order to facilitate advancement of the displayed schedule element upon successful removal and replacement of the cap onto the cylindrical container. In the example medicine-dispenser embodiment of the present invention illustrated in FIGS. 1-5, there are 14 biasing features positioned uniformly along the inner circumference of the built-in schedule display at uniform positions with respect to the lower edge 510 of the built-in schedule display. In addition, the built-in schedule display includes two grips 512 and 514 that extend downward from the inner surface of the disk-shaped top portion (212 in FIG. 2) of the built-in schedule display. These two grips allow for initial positioning of a particular schedule element below the display aperture (110 in FIG. 1) of the cap rim to provide an initial administration-time indication for administration of a first dose.

Figure 6:
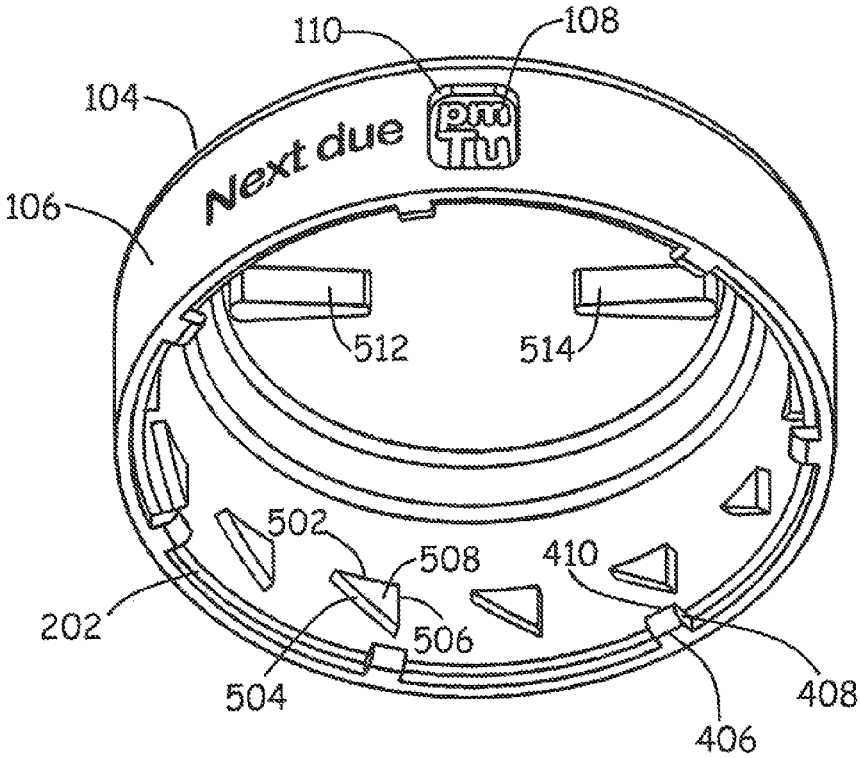
FIG. 6 is a perspective view of the cap of the embodiment of the present invention shown in FIG. 1.

FIG. 6 is a perspective view of the cap of the embodiment of the present invention shown in FIG. 1. In FIG. 6, the built-in schedule display 202 is shown inserted into the cap 104 to produce a fully assembled cap with built-in schedule display. Note that the built-in schedule display is pushed into the cap past the seven lugs, such as lug 406, which snap the built-in display into position and hold the built-in display within the cap. Note also that the built-in schedule display is rotatably mounted within the cap, although the cap ratchet wheel (402 in FIG. 4) and schedule-display ratchet wheels are partially engaged, when the cap is not affixed to the container, and this partial engagement prevents the built-in schedule display from freely rotating within the cap, but allows the built-in schedule display to be rotated in order to select a particular schedule element for display through the cap aperture (110 in FIG. 1) by applying a rotational force to grips 512 and 514. As discussed below, when the cap is affixed to the cylindrical container, features of the built-in schedule display, discussed below, apply pressure to the schedule-display ratchet wheel to fully mesh the schedule-display ratchet wheel together with the cap ratchet wheel to prevent rotation of the schedule-display with respect to the cap. Thus, in general, the schedule display remains in a fixed position with respect to the cap, whether or not the cap is fastened to the container, but is relatively loosely held in position, when the cap is not affixed to the container, allowing the schedule display to be manually rotated with respect to the cap in order to select a particular schedule element for display by applying pressure to grips 512 and 514.

While the example medicine dispenser shown in FIGS. 1-6 includes 14 ratchet teeth on each ratchet wheel, seven lugs, seven boss features, and 14 biasing features, the number of these features may be altered, in alternative embodiments, in order to provide for a different number of schedule elements. In these alternative embodiments, the ratio of two biasing features to one boss feature is preserved in order to facilitate advancement of the displayed schedule element by one element when the cap is removed and reaffixed to the container. However, in yet additional embodiments, this ratio may also be altered.

Figure 7:
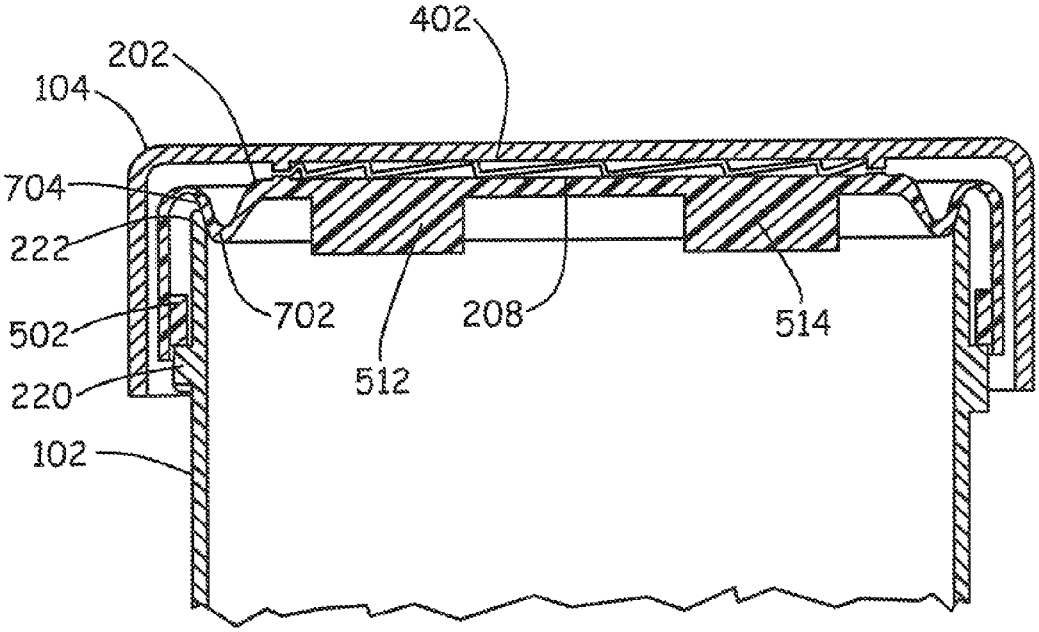
FIG. 7 is a cross-section view of a portion of the embodiment of the present invention shown in FIG. 1.

FIG. 7 is a cross-section view of a portion of the embodiment of the present invention shown in FIG. 1. As mentioned above, FIG. 7 shows a cross-sectional view of the medicine-dispenser embodiment of the present invention shown in FIGS. 1-6 with respect to a plane that intersects the cap along line 302 in FIG. 3. FIG. 7 includes numeric labels used above in FIGS. 1-2 and 4-6. The cross-sectional view shown in FIG. 7 illustrates the medicine-dispenser embodiment of the present invention when the cap is firmly attached to the container. FIG. 7 reveals an additional feature of the built-in schedule display. As shown in cross-section, the built-in schedule display features an inner rim 702 with a wedge surface 704 against which the upper edge, or lip, of the cylindrical container (222 in FIG. 2) presses against when the cap is affixed to the cylindrical container. The pressure applied by the cylindrical container to the wedge surface 704 of the inner rim 702 forces the schedule-display ratchet wheel 208 upward to fully mesh together with the complementary cap ratchet wheel 402, locking the position of the built-in schedule display with respect to the cap as well as providing an air-tight, gasket-like seal to provide air-tight containment of medicine within the cylindrical container. When the cap is affixed to the cylindrical container, as discussed further below, each lug (406 in FIG. 4) is locked within the lug notch (230 in FIG. 2) of a boss feature (220 and 236 in FIG. 2).

Figure 8:
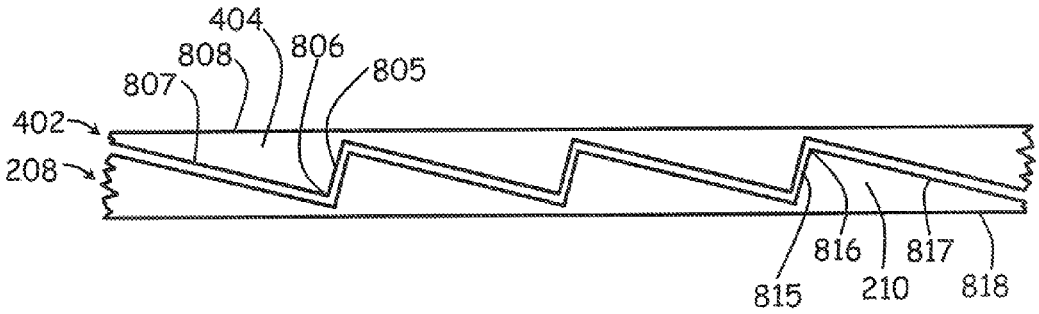
FIG. 8 is an enlarged unwrapped view of a portion of the cap ratchet wheel and the schedule-display ratchet wheel of the embodiment of the present invention shown in FIG. 1

FIG. 8 is an enlarged unwrapped view of a portion of the cap ratchet wheel and the schedule-display ratchet wheel of the embodiment of the present invention shown in FIG. 1. FIG. 8 illustrates how the cap ratchet wheel meshes together with the schedule-display ratchet wheel. As shown in FIG. 8, the cap ratchet wheel 402 includes a series of 14 teeth, such as tooth 404. The teeth protrude from a cap ratchet-wheel base 808. Each tooth includes an engaging side 805, a tip 806, and a sliding side 807. Similarly, the schedule-display ratchet wheel 208 includes a series of 14 teeth, such as tooth 210, each of which also includes an engaging side 815, a tip 816, and a sliding side 817, with the teeth disposed along a schedule-display ratchet-wheel base 818.

Affixing and removing the cap-and-schedule-display assembly to and from the cylindrical container 102 is similar to affixing and removing caps from commonly-available child-proof pill bottles. Apply cap 104 to cylindrical container 102. Apply pressure to cap 104 and rotate clockwise. Lugs 406 slide into spaces 234 between boss features 220. Each lug 406 encounters and slides around the cam surface 224 of one of the boss features 220. Sliding of the lugs 406 around the cam surfaces 224 draws the cap 104 onto the cylindrical container 102 and compresses schedule-display 202. Inner rim 702 of the schedule-display 202 provides flexibility, enabling the schedule display to compress vertically. As the cap 104 draws onto cylindrical container 102, the wedge surface 704 of the inner rim 702 presses into the lip 222 of the cylindrical container to provide an airtight seal. When the lugs 406 reach the stop portion 232 of boss features 220, the cap 104 can no longer rotate. Compression of the schedule-display 202 pulls lugs 406 up into lug notches 230. The cap 104 is now affixed to cylindrical container 102.

Figure 9A:
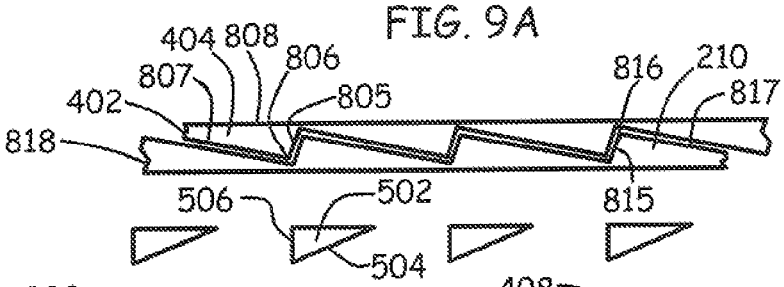
FIGS. 9A-H provide unwrapped views of cap, schedule-display, and bottle components of the embodiment shown in FIG. 1 that illustrate step-by-step interaction of these components as the cap is affixed to and removed from the pill bottle.
Figure 9A:
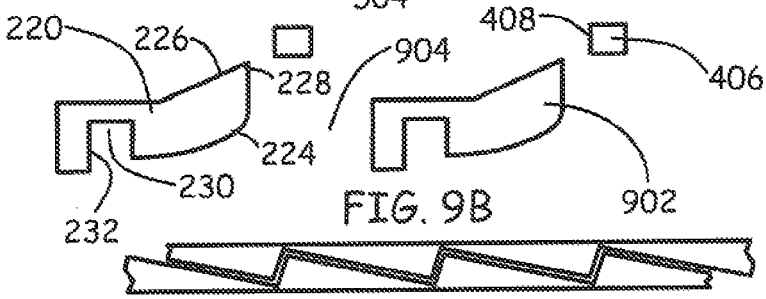
Figure 9B:
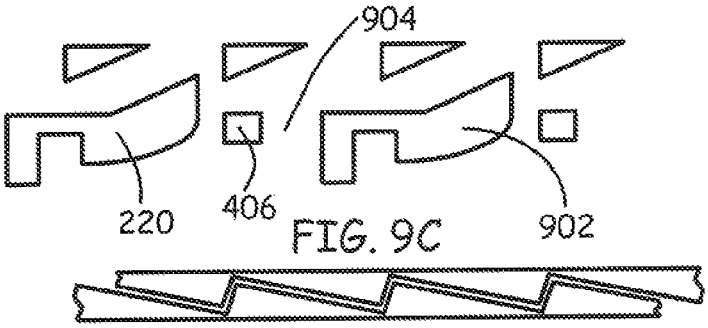
Figure 9C:
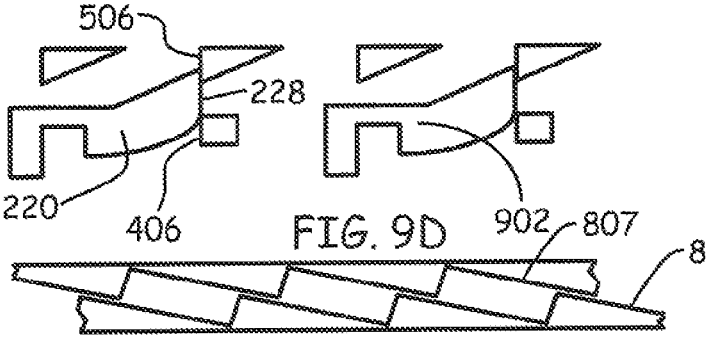
Figure 9D:
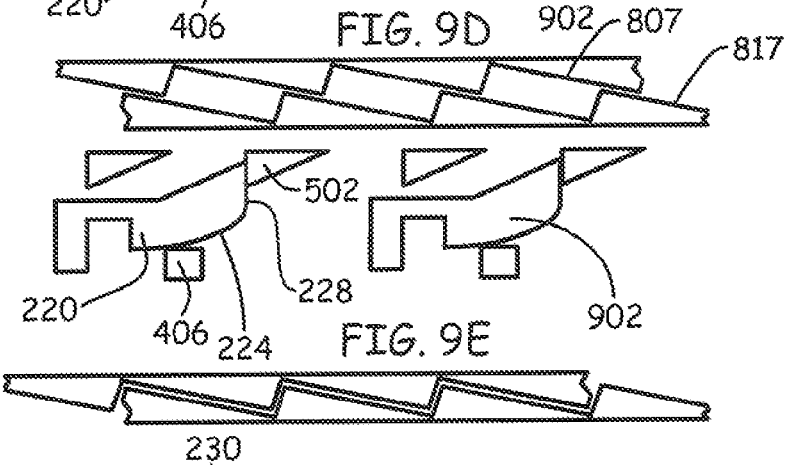
Figure 9E:
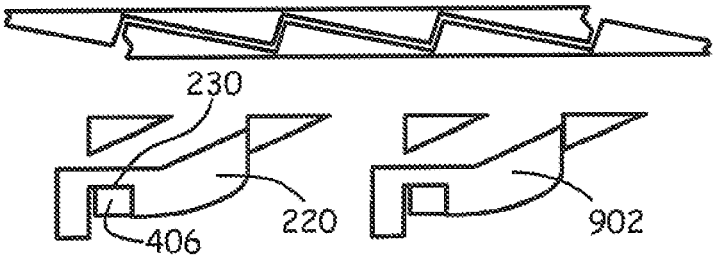

FIGS. 9A-H provide unwrapped views of cap, schedule-display, and bottle components of the embodiment shown in FIG. 1 that illustrate step-by-step interaction of these components as the cap is affixed to and removed from the pill bottle. FIGS. 9A-E illustrate the process of affixing the cap to the cylindrical container and the interaction of the various features and components during this process. As shown in FIG. 9A, prior to affixing the cap onto the container, the cap ratchet wheel 402 and schedule-display ratchet wheel 208 are meshed together at least partially, fixing the position of the schedule display with respect to the cap. Moreover, the leading edge 408 of each lug 406 is aligned with an abutment surface 506 of a biasing feature. This alignment is imposed by the meshing of the cap ratchet wheel with the schedule-display ratchet wheel, the fixed positions of the lugs with respect to the cap ratchet wheel, and the fixed positions of the biasing features with respect to the schedule-display ratchet wheel. When the cap is placed onto the cylindrical container and rotationally adjusted as the cap is forced down, the lugs 406 slip into the spaces 904 between boss features 220 and 902. Note that, during this process, meshing together of the cap ratchet wheel with the schedule-display ratchet wheel ensures that the schedule display turns with the cap and remains in a fixed position relative to the cap. Next, as shown in FIG. 9C, when the cap is rotated in a clockwise direction, the abutment surface 506 and leading side 408 of each aligned pair of biasing features and lugs comes into contact with the leading edge 228 of a boss feature 236. As shown in FIG. 9D, as the cap continues to be rotated in a clockwise position, the biasing features 502 are prevented from rotating along with the cap by the leading edge 228 of the boss features with which they contact while the lugs 406 extending from the cap continue rotating along with the cap in a clockwise direction along the cam surface 224 of the boss feature. Because the rotation of the schedule display is prevented while the cap continues to rotate, the sliding sides of the teeth of the cap ratchet wheel slide on the sliding sides 817 of the teeth of the schedule-display ratchet wheel as the cap rotates with respect to the schedule display. Flexibility in schedule display 202 provided by inner rim 702 allows schedule display 202 to compress so that cap ratchet wheel 402 and schedule-display ratchet wheel 208 can slip over each other in the disengaged direction. As cap 104 rotates around schedule-display 202, aperture 110 moves from one schedule element 204 to the next. In the example embodiment leading edges 228 are a flat abutment surface. In practice, cam surfaces 224 can be extended upwards to the top of ramp portion 226 thereby shortening leading edges 228 so that they are a shorter flat vertical surface or are pointed. Finally, as shown in FIG. 9E, the lugs 406 slip into the lug notches 230 of the boss features 220 and 902 as the teeth of the cap ratchet wheel interlock again with the teeth of the cap ratchet wheel advanced clockwise by one tooth with respect to the schedule-display ratchet wheel. Thus, attaching the cap to the cylindrical container results in advancement of the displayed schedule element by one element along the sequence of schedule elements disposed along the circumference of the cylindrical schedule-display rim.

Figure 9F:
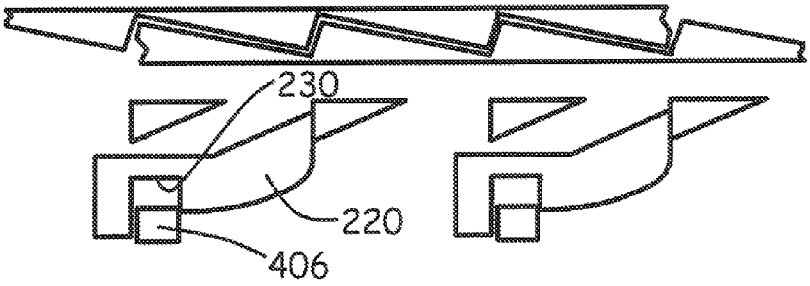
Figure 9G:
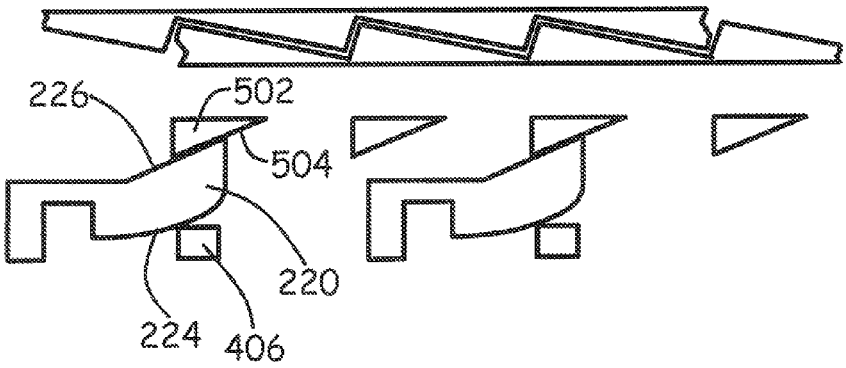
Figure 9H:
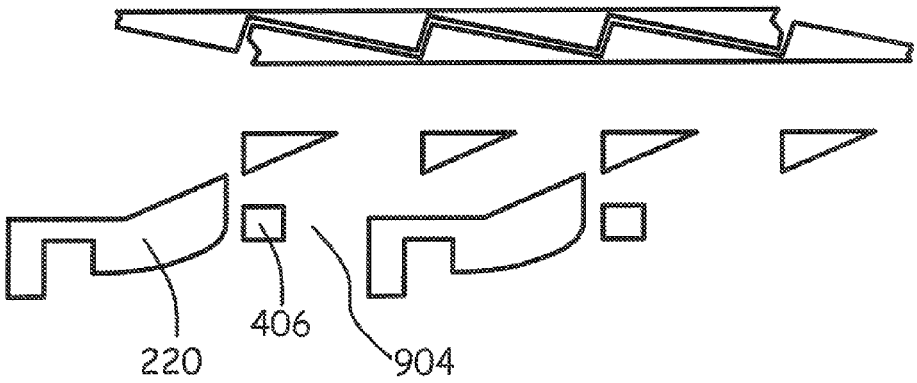

FIGS. 9F-H illustrate components and features of the medicine-dispenser embodiment of the present invention discussed with reference to FIGS. 1-9E as the cap is removed from the container. As shown in FIG. 9F, to remove the cap, a user initially pushes down on the cap, forcing the lugs 406 to disengage from the lug notches 230 of the boss features 220 and 902. Next, as shown in FIG. 9G, the cap is rotated in a counter-clockwise direction, with each lug 406 traveling along the cam surface 224 of each boss feature 220 and 902 while the sliding surface 504 of each biasing feature 502 slides along the ramp portion 226 of the boss feature. As biasing features 502 slide over ramp portions 226, schedule-display 202 is pushed upwards into cap 104. This maintains both contact and pressure between cap ratchet wheel 402 and schedule-display ratchet wheel 208 when lugs 406 move around cam surfaces 224 of boss features 220 and 902, and cap 104 starts to move up and away from cylindrical container 102. Finally, as shown in FIG. 9H, the lugs 406 fully disengage from the boss features 220 and 902 and reside in the space 904 between successive boss features 220 and 902 allowing the cap to be vertically pulled away from the container. During the entire sequence of steps shown in FIGS. 9F-H, the schedule display is affixed in position with respect to the cap as a result of intermeshing of the cap ratchet wheel and the schedule-display ratchet wheel. Human-applied pressure on cap 104 forces cap ratchet wheel 402 and schedule-display ratchet wheel 208 together, further increasing friction so that they will not slide past each other and do not slip a single position. Schedule-display 202 is thus compelled to rotate counterclockwise in lock-step with cap 104.

In the example embodiment cap and schedule-display ratchet wheels 402 and 208 form a biasing means in the counterclockwise direction. This function could also be provided by a variety of mechanisms connecting the top of the schedule-display to the bottom of the cap, including prongs, pawls, or variety of projections, notches or grooves on one component and a complimentary mechanism on the other. It is also conceivable that biasing means could be established anywhere between the outside of schedule-display 202 and the inside of cap 104. For example, biasing means could be located between cylindrical cap rim 106 and display surface 206 and can utilize any of the aforementioned means. In the example embodiment biasing features 502 are wedge-shaped projections. However, a variety of shapes with a side to engage the boss features in one direction and a side to slide over ramp portions 226 in the other direction can be used.

In the example embodiment after cap 104 is removed from cylindrical container 102, compression in schedule-display 202 created from affixing it inside cap 104 aids in increasing friction between cap ratchet wheel 402 and schedule-display ratchet wheel 208 to prevent schedule-display 202 from unintentionally advancing. However compression is not necessary for sufficient friction if cap ratchet wheel 402 and schedule-display ratchet wheel 208 are partially engaged. Alternatively, friction between the inner surface of the cylindrical cap rim 106 and the display surface 206 may also suffice.

Figure 10:
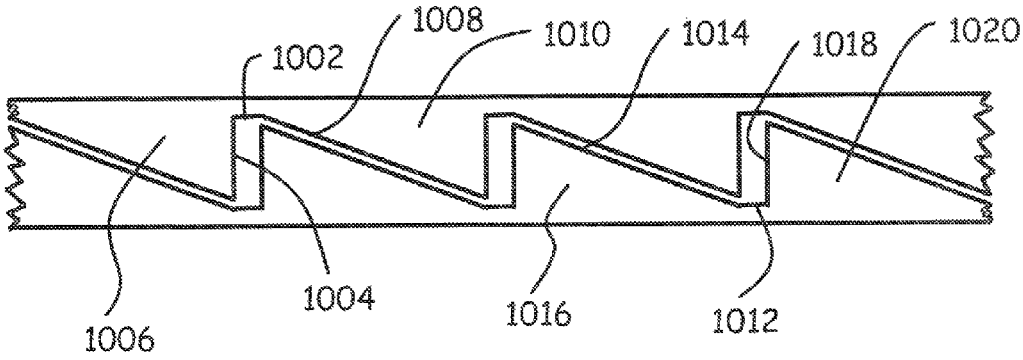
FIG. 10 is an enlarged unwrapped view of an alternative embodiment of the cap ratchet wheel and schedule-display ratchet wheel.

FIG. 10 is an enlarged unwrapped view of an alternative embodiment of the cap ratchet wheel and schedule-display ratchet wheel. In this alternative embodiment, an additional horizontal edge 1002 separates the engaging side 1004 of a first cap-ratchet-wheel tooth 1006 from the sliding edge 1008 of a successive cap-ratchet-wheel tooth 1010 and, similarly, a short horizontal edge 1012 separates the sliding side 1014 of each schedule-display ratchet-wheel tooth 1016 from the engaging side 1018 of a successive schedule-display ratchet-wheel tooth 1020. The purpose of the embodiment shown in FIG. 10 is to provide an alternative method for altering common ratchet-wheel teeth so that cap 104 snaps into place via schedule-display 202 before lugs 406 reach stop portion 232 of boss features 220. This alternative embodiment can replace ratchet wheels 402 and 208 in the example embodiment or any modified embodiment described in this document. In this alternative embodiment, the ratchet-wheel teeth are shortened so that they are not contiguous, creating spaces along bases of the cap ratchet wheel and schedule-display ratchet wheel. When cap 104 is placed on cylindrical container 102 and rotated clockwise for the purpose of affixing the cap to the cylindrical container, the ratchet-wheel tips slip past one another before the leading sides 408 of lugs 406 reach stop portions 232 of boss features 220.

Grips 512 and 514 on schedule-display 202 enable a person to manually adjust which schedule element is visible through aperture 110. In the example embodiment, grips 512 and 514 together compose a pair of raised tabs that can be engaged by fingers. However, a single tab as well as a variety of protrusions, indentations, and or holes can provide the same function in alternative embodiments. These features can either be part of, or connected to, the underside of disk-shaped portion 212 of the schedule-display 202, the inner side of the cylindrical rim of the schedule display, or connected to both.

One feature of the design of the example embodiment of the present invention is that the display surface 206 provides a space to print, imprint, emboss, deboss or adhere schedule elements, because the display surface provides sufficient space on schedule display 202 for large characters and symbols. Furthermore the height of the display surface 206 can be extended along with cylindrical cap rim 106 to accommodate even larger characters and symbols without widening cylindrical container 102.

In alternative embodiments, the schedule is instead located on the disk-shaped portion of the schedule-display and the aperture is located on the top surface of the cap. In yet additional alternative embodiments, the schedule elements are visible and the aperture is replaced with an indicator or arrow which designates or points to an individual schedule element. The placement of the indicator and schedule elements can be swapped so that the schedule elements are on the cap and the indicator is on the schedule-display in certain embodiments.

Embodiments of the present invention do not require spring tension or bending of components which are likely to be manufactured out of plastic, nor do they require the use of spring fingers or other types of narrow extensions prone to wear and breakage. Furthermore, embodiments of the present invention function without overly stressing any of the three components, facilitating the reduction and/or elimination of wear. Therefore, embodiments of the present invention achieve a higher level of durability for safe dispensing of prescription medications.

The next section more specifically describes attributes of the example embodiment that allow the example embodiment to advance precisely one schedule element at a time, re-align for each next cycle, work automatically and flawlessly, prevent human error, incur little wear, continue to work with some wear, function when some of the components are manufactured imperfectly, and be calibrated to various numbers of schedule elements.

Component proportions, ratios between the numbers of various components, and alignment of various components contribute to the proper functioning of the example embodiment. Components of the example embodiment described in this section are proportioned to control the degrees of relative rotation between cap 104, schedule-display 202, and cylindrical container 102. Therefore the length or proportion of various components as well as the spacing of various components is described in terms of the degrees of the central angle of their arc around the central axis of the example embodiment rather than as a particular size or scale. The central axis is an imaginary vertical line through the center of the embodiment. Lateral arcs are used to describe the rotational distance between two components that may differ in their vertical placement on the example embodiment.

In the example embodiment the central angle of the lateral arc from the leading edge 228 to the stop portion 232 of each boss feature 220 and the alignment of biasing features 502 with lugs 406 determines the number of degrees by which cap 104 rotates around schedule-display 202 each time the cap is mounted to cylindrical container 102.

Cap ratchet wheel 402 is rotationally positioned relative to lugs 406 and schedule-display ratchet wheel 208 is rotationally positioned relative to biasing features 502 so that, when cap ratchet wheel 402 is fully meshed with schedule-display ratchet wheel 208, leading sides 408 of lugs 406 are vertically aligned with the abutment surfaces 506 of a portion of biasing features 502. When cap 104 is affixed to cylindrical container 102 and rotated clockwise, abutment surfaces 506 of a portion of biasing features 502 contact leading edges 228 of boss features 220, preventing further rotation of the indicator while cap 104 continues to rotate until lugs 406 reach stop portions 232. Cap 104 thus rotates around schedule-display 202 the same number of degrees as the lateral arc from the leading edge 228 to the stop portion 232 of each boss feature 220.

Boss features 220 are proportioned so that, when the cap 104 advances around schedule-display 202 through a predetermined number of mounting cycles, the cap rotates 360 degrees relative to schedule display 202 and re-centers aperture 110 over the starting schedule element. Aperture 110 on cap 104 is rotationally positioned relative to the cap ratchet wheel 402 on its underside and schedule elements are positioned around the display surface 206 relative to schedule-display ratchet wheel 208 so that when cap ratchet wheel 402 is meshed with schedule-display ratchet wheel 208, aperture 110 is centered over one schedule element 204.

The central angle of the lateral arc between the leading edge 228 and stop portion 232 of each boss feature 220 of the example embodiment is a unit fraction (a fraction with numerator=1 and denominator=an integer) of 360 degrees. Therefore cap 104 and thus aperture 110 advance a unit fraction of 360 degrees during each mounting cycle. When cap 104 is removed from and affixed to cylindrical container 102 a number of times equal to the denominator of the unit fraction of the central angle between the leading edge 228 and the stop portion 232 of each boss feature 220, the cap advances around schedule-display by 360 degrees.

The proportions of boss features 220 are coordinated with the desired number of schedule elements. Schedule elements are evenly spaced around schedule-display 202 in increments of 360 degrees divided by the number of schedule elements. In the example embodiment, boss features 220 are proportioned so that the central angle of the lateral arc from the leading edge 228 to the stop portion 232 is also equal to 360 degrees divided by the number of schedule elements. Therefore in each mounting cycle, aperture 110 accurately advances from the center of one schedule element to the center of the next schedule element.

In the example embodiment, the proportions of boss features 220 and the spacing and number of biasing features 502 also are coordinated so that, at the end of each mounting cycle, each of the relevant components is re-aligned and the device is ready for the next mounting cycle.

Biasing features 502 of the example embodiment are spaced in degree increments around schedule-display 202 equal to the central angle of the lateral arc between leading edge 228 and stop portion 232 of each boss feature 220. This is also the number of degrees by which cap 104 rotates around the indicator during each cycle. When cap 104 is applied to cylindrical container 102 and rotated clockwise for mounting, the leading side 408 of each lug 406 starts in vertical alignment with abutment surface 506 of one biasing feature 502. With biasing features 502 so spaced, at the end of each cycle, each lug 406 on cap 104 rotates into the same relative vertical alignment with the next sequential biasing feature 502. Cap 104 and schedule-display 202 thereby align for the next cycle.

The numbers of biasing features 502, lugs 406, and boss features 220 are also coordinated. Between cycles, each lug 406 is aligned relative to a biasing feature 502. During each cycle, lugs 406 advance to each align relative to their next sequential biasing feature 502. In future cycles, each lug 406 aligns relative to a biasing feature 502 previously aligned relative to preceding lugs. For this process to work indefinitely, the number of biasing features 502 is an integer multiple of the number of lugs 406.

The number of biasing features 502 in the example embodiment is an integer multiple of the number of lugs 406. The number of lugs 406 is equal to the number of boss features 220. The number of biasing features 502 is therefore also an integer multiple of the number of boss features 220.

With each mounting cycle, aperture 110 rotates to center over the next schedule element in the sequence of schedule elements 204 while lugs 406 each rotate into alignment with the next sequential biasing feature 502. Schedule elements 204 and biasing features 502 are therefore spaced in equal degree increments around schedule-display 202 and are therefore also equal in number. The number of schedule elements 204 is therefore also an integer multiple of the number of boss features 220 on cylindrical container 102.

The number of teeth 210 and 404 are also coordinated with the number of schedule elements 204 and biasing features 502 and the proportions of boss features 220. The number of teeth 210 and 404 is an integer multiple of the number of schedule elements 204 and biasing features 502. At the beginning of each cycle, cap ratchet wheel 402 and schedule-display ratchet wheel 208 are fully meshed. Because the number of teeth are an integer multiple of the number of biasing features 502, when cap 104 advances through one cycle, cap ratchet wheel 402 and schedule-display ratchet wheel 208 rotate by a whole number of teeth so that they finish each cycle in the fully meshed position. Aperture 110 is then centered over one schedule element 204. Because they are in the fully meshed position, cap ratchet wheel 402 and schedule-display ratchet wheel 208 do not slip and rotate in relationship to each other when the cap 104 is rotated counterclockwise for the purpose of removing the cap from cylindrical container 102.

The example embodiment has one tooth on each ratchet wheel per schedule element for the purpose of preventing human error. When more than one tooth per schedule element is present, a user feels a bump each time the tips of the ratchet-wheel teeth slip over one another. The feeling of teeth slipping over each other is often confused with the sensation of completing the process of affixing the cap when the lugs snap into the lug notches. The cap and schedule-display ratchet wheels 402 and 208 are rotationally positioned relative to cap 104 and schedule-display 202 so that, when affixing cap 104 to cylindrical container 102, a person feels the cap and schedule-display ratchet wheels 402 and 208 slipping into place simultaneously with lugs 406 sliding into lug notches 230.

Furthermore, when a person attempts but fails to affix cap 104 properly and lugs 406 fail to slide all the way into lug notches 230, then teeth on the cap and schedule-display ratchet wheels 402 and 208 do not slip past each other, and cap 104 and aperture 110 do not inadvertently advance around schedule-display 202. Furthermore, compression in the inner rim 702 of schedule-display 202 pushing cap and schedule-display ratchet wheel 402 and 208 together will cause the teeth to settle back into their original positions, preventing an inadvertent indication. Therefore, cap 104 only makes an indication if the cap is successfully and completely affixed to cylindrical container 102. It should be clear from this description that the example embodiment functions automatically, accurately, and prevents human error. Furthermore, it should also be clear that no conscious human effort or control is needed for the example embodiment to make its indications. Thus, unlike prior art, the example embodiment is not prone to human error caused by failed attempts to adhere the cap to the cylindrical container.

The example embodiment is also designed to make exactly one indication every time cap 104 is affixed to cylindrical container 102 despite manufacturing imperfection and possible device wear. To ensure device accuracy despite these variations, the ratchet-wheel teeth in the example embodiment are modified from common ratchet wheel-teeth. Common ratchet-wheel teeth are contiguous and the engaging side of each tooth is either 90 degrees with respect to its base or is slanted away from its sliding side. In the example embodiment of the present invention, engaging sides 805 of the ratchet-wheel teeth are slightly slanted towards the sliding sides 807. Because they are complimentary, engaging sides 815 of the ratchet-wheel teeth are also slightly slanted toward sliding sides 817. More precisely, the inside angle between engaging side 805 and cap-ratchet-wheel base 808 as well as the inside angle between engaging side 815 and schedule-display ratchet-wheel base 818 is acute. This slant reduces the distance cap 104 needs to rotate around schedule-display 202 to advance the tips of the ratchet-wheel teeth past one another while still maintaining a desired number of teeth.

When cap 104 is affixed to cylindrical container 102, the ratchet wheel teeth tips pass one another and the cap 104 snaps into position with schedule-display 202 momentarily before lugs 406 reach stop portions 232 of boss features 220 and pull into lug notches 230. Sequentially advancing the motion of cap 104 snapping into position with schedule-display 202 before lugs 406 snap into lug notches 230 reduces the precision required to ensure the example embodiment correctly displays the next schedule element. This enables the medicine dispenser to function properly despite a range of user and manufacturing variations as well as potential wear from use.

The difference in timing between cap ratchet wheel 402 on cap 104 snapping into place with schedule-display ratchet wheel 208 on schedule-display 202 and lugs 406 snapping into place with lug notches 230 on cylindrical container 102 is sufficiently slight so that it is imperceptible to a common user. The example embodiment therefore maintains a desired and familiar tactile experience by which a user feels one click when affixing cap 104 to cylindrical container 102.

The time interval between the above-mentioned events is sufficiently short so that, while affixing cap 104 to cylindrical container 102, it is not generally possible for a common person to advance the ratchet-wheel teeth on the cap and schedule-display ratchet wheels 402 and 208 without completing the motion of rotating lugs 406 all the way to stop portion 232 of boss features 220, completing the cycle. The example embodiment therefore also maintains the desired property of advancing the displayed schedule element only when cap 104 is properly affixed to cylindrical container 102. Furthermore, the slant on engaging sides 805 and 815 of the ratchet-wheel teeth is sufficiently slight so as not to interfere with their locking function when the cap 104 is rotated counterclockwise and removed from cylindrical container 102.

The mechanism utilized by the example embodiment to make indications is also designed to conform to most common prescription drug regimens. Most prescriptions require the consumption of an exact number of pills each day. To help a user adhere to a daily schedule, the medicine dispenser should have one schedule element for each dose for each day of the week. The number of required schedule elements is therefore most often a multiple of seven days of the week.

The number of schedule elements 204 is an integer multiple of the number of boss features 220 on cylindrical container 102. Accordingly, the example embodiment is designed with seven boss features 220 and fourteen schedule elements 204. The central angle of the lateral arc from the leading edge 228 to stop portion 232 of each boss feature 220 is one-fourteenth of 360 degrees. Thus, cap 104 advances one-fourteenth of the way around schedule-display 202 in each cycle. Schedule-display 202 shown in FIG. 5 has schedule elements 204 calibrated for two doses per day, one for AM and a second for PM for each day of the week. An alternative embodiment calibrated for one dose per day would have the same number of boss features 220, lugs 406, ratchet-wheel teeth, and schedule elements. However, the schedule elements would consist of two sequential seven day sequences each with one schedule element for each day of the week.

The mechanism utilized by the example embodiment is designed so that the dimensions of boss features 220 and the coordinated number of biasing features 502, ratchet-wheel teeth, and schedule elements 204 can be calibrated to accommodate other daily prescription schedules.

For example, another embodiment designed for three doses per day would also have 7 boss features and 21 schedule elements, one for each of the three doses for each day of the week. The boss features would be proportioned so that the central angle of the lateral arc from the leading edge to the stop portion of each boss feature would be 360 degrees divided by 21. To conform to schedules that are not correlated to seven days of the week, an alternative embodiment may be created with a different number of boss features. For example, a cylindrical container with 6 boss features could be calibrated to hourly and monthly schedules since hours of the day and months of the year are both multiples of 6.

Embodiments of the present invention provide mechanical advantages over currently-available devices. First, embodiments of the present invention can be effectively calibrated to any number of schedule elements that are a multiple of seven days of the week and can therefore conform to the most common prescription schedules. Embodiments of the present invention also provide a means for manual adjustment to a correct indication. This is particularly helpful for presetting the indicator to a correct day and time of the first dosage. Embodiments of the present invention include a commonly-accepted form of childproofing, are airtight, and do not require a non-standard method of applying the cap to the cylindrical container.

The mechanism utilized by certain embodiments of the present invention does not require conscious effort or control from a person for it to make accurate indications. And, the displayed schedule element is not advanced unless the cap is successfully affixed to the cylindrical container, thus eliminating potential human error. Furthermore, the displayed schedule element advances one schedule element at a time and, at the end of each cycle, is automatically realigned for the next cycle.

Additionally, embodiments of the present invention function without straining or bending any of components so that embodiments of the present invention are less prone to usage wear. None of the components consists of thin plastic extensions that are likely to rapidly wear out or break. And, while embodiments of the present invention do not incur undue wear, embodiments of the present invention are also designed to function accurately despite some material wear, thereby further enhancing safety.

Furthermore, each of the components of the example embodiment can be rapidly mass-manufactured with simple molds. And, each of the example embodiments can be manufactured as just three pieces and can be made of the same materials from which common embodiments of commercially-available pill bottles are manufactured. Additionally, the indicating mechanism utilized by the current embodiments is designed to function properly despite potential variations in manufacturing accuracy.

Although the present invention has been described in terms of particular embodiments, it is not intended that the invention be limited to these embodiments. Modifications will be apparent to those skilled in the art. For example, as mentioned above, the number of ratchet-wheel teeth, biasing features, boss features, lugs, and schedule elements can be varied, in alternative embodiments, in order to provide different numbers of schedule elements. In alternative embodiments, a means for rotating the schedule display with respect to the cap in order to set an initial schedule display element may be used instead of the grips 512 and 514 discussed above with reference to FIG. 5. In certain embodiments, features complementary to an initial-schedule-element setting tool can be used to ensure that the schedule is set by a pharmacist or other healthcare provider. As discussed above, the schedule elements contain various different types of information related to times, days of the week, dates, and other such characteristics that define when a next dose is to be administered. The schedule elements may be molded, embossed, printed, or otherwise placed onto the exterior wall of the schedule-display rim. The dimensions and shapes of each of the component features may vary with varying embodiments provided that they interoperate together as described above. The cap, schedule display, and cylindrical container may be manufactured in any of many well-known polymeric materials, and can have essentially arbitrary colors, transparencies, rigidity and flexibility, and other such characteristics and parameters. The cylindrical container and cap may contain additional features, including additional information displays, features for facilitating attachment of additional information by pharmacies and pharmacists, and other features.

It is appreciated that the previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A medicine dispenser comprising:

a disc-shaped cap having a cylindrical rim with a schedule-element display aperture, a ratchet wheel, and a number of lugs extending radially inward from a lower edge of the cap;

a disc-shaped schedule-display element, mounted within the cap to form a cap-and-schedule-display assembly, having a cylindrical rim with an outer display surface along which schedule elements are positioned, a ratchet wheel complementary to the ratchet wheel of the cap, one or more grips on an inner surface, and biasing features extending from an inner surface of the cylindrical rim; and a cylindrical container, onto which the cap-and-schedule-display assembly is mounted, which includes boss features regularly spaced along an outer surface and positioned to interact with the lugs and biasing features to provide child-proof locking of the cap and to advance a displayed schedule element by one and only one element when the cap is removed and reaffixed to the cylindrical container.

2. A medicine dispenser consisting of:

a medicine container;

a schedule display that includes schedule indications, located at evenly spaced schedule-indication positions on the schedule display, that together comprise a dispensing schedule with dispensing-schedule positions; and a cap, to which the schedule display is mounted, that is removably secured to the medicine container and that includes a schedule-indication-display aperture through which a schedule indication representing a next dispensing event is exposed, wherein the cap is removed from the medicine container by rotation with respect to the medicine container in a first direction, the cap is re-secured to the medicine container by rotation with respect to the medicine container in a second direction opposite to the first direction, and the schedule-indication exposed through the schedule-indication-display aperture is advanced by one and only one dispensing-schedule position during each dispensing cycle, and wherein the schedule indication exposed through the schedule-indication-display aperture is advanced only by either completion of a dispensing cycle or by deliberate manual advancement when the cap is removed from the medicine container.

3. The medicine dispenser of claim 2 wherein the schedule indication exposed through the schedule-indication-display aperture is advanced by one dispensing-schedule position, from any initial dispensing-schedule position within the dispensing schedule, during a single dispensing cycle, the dispensing-schedule position advanced to a first position of the dispensing schedule from a last position of the dispensing schedule when the schedule indication in the last position of the dispensing schedule is exposed through the schedule-indication-display aperture at the beginning of the dispensing cycle.

4. The medicine dispenser of claim 2 wherein the cap, schedule display, and medicine container are each single-piece components.

5. The medicine dispenser of claim 2 wherein the medicine container is a cylindrical container having a hollow cylindrical body, a first closed end, and a second open end to which the cap is removably secured;

wherein the cap comprises a disk-shaped portion with a cylindrical wall having a cylindrical axis perpendicular to the disk-shaped portion, the cylindrical wall including the schedule-indication-display aperture; and wherein the schedule display comprises a disk-shaped portion with a cylindrical wall having a cylindrical axis perpendicular to the disk-shaped portion, the dispensing schedule provided on an outer surface of the cylindrical wall, the schedule display mounted within the cap so that relative rotation of the schedule display with respect to the cap by a fixed rotational angle advances the schedule-indication-display aperture by one position with respect to the dispensing schedule.

6. The medicine dispenser of claim 5 wherein the outer surface of the cylindrical body of the medicine container includes a first number of evenly spaced boss features;

wherein the inner surface of the disk-shaped portion of the cap includes a first ratchet wheel complementary to a second ratchet wheel on the outer surface of the disk-shaped portion of the schedule display;

wherein a second number of lugs protrude inward from the lower portion of the inner surface of the cylindrical wall of the cap;

wherein the inner surface of the disk-shaped portion of the schedule display includes one or more manual-manipulation features; and wherein a third number of biasing features are evenly spaced along the inner surface of the cylindrical wall of the schedule display.

7. The medicine dispenser of claim 6 wherein, when the cap is pushed down onto the medicine container during securing of the cap to the medicine container, the lugs fit between spaces between the boss features, and when the cap is then rotated in a first direction, the lugs move along the boss features while a portion of the biasing features are hindered from rotation by interaction with leading edges of the boss features, resulting in a relative rotation of the schedule display with respect to the cap that, in turn, advances the schedule-indication-display aperture by one position with respect to the dispensing schedule.

8. The medicine dispenser of claim 6 wherein, when the cap, in an initially secured configuration, is rotated in a second direction, the lugs move along the boss features the portion of the biasing features are not hindered from rotation by the boss features, resulting in no relative rotation of the schedule display with respect to the cap.

9. The medicine dispenser of claim 6 wherein, when the cap is rotated in the first direction, the first and second ratchet wheels do not prevent rotation of the schedule display with respect to the cap whereas, when the cap is rotated in the second direction, the first and second ratchet wheels intermesh to transfer rotational force from the cap to the schedule display.

10. The medicine dispenser of claim 6 wherein the first number is equal to an integer multiple of the second number and the third number is an integer multiple of the first number.

11. The medicine dispenser of claim 6 wherein each of the first and second ratchet wheel includes a fourth number of teeth; and wherein the fourth number is an integer multiple of the first number.

12. The medicine dispenser of claim 6 wherein, when the cap is in a secured configuration, the lugs are secured within notches of the boss features.

13. The medicine dispenser of claim 12 wherein a central angle of a lateral arc between a leading edge of each boss feature and a trailing edge within the notch of the boss feature is equal to 360 degrees divided by the number of dispensing-schedule positions.

14. A medicine dispenser comprising:

a medicine container;

a schedule display that includes schedule indications, located at evenly spaced schedule-indication positions on the schedule display, that together comprise a dispensing schedule with dispensing-schedule positions; and a cap, to which the schedule display is mounted, that is removably secured to the medicine container and that includes a schedule-indication-display aperture through which a schedule indication representing a next dispensing event is exposed, the cap removed from the medicine container by rotation with respect to the medicine container in a first direction, re-secured to the medicine container by rotation with respect to the medicine container in a second direction, opposite to the first direction, and the schedule indication exposed through the schedule-indication-display aperture advanced by one and only one dispensing-schedule position during each dispensing cycle from any initial dispensing-schedule position prior to initiation of the dispensing cycle.

15. The medicine dispenser of claim 14 wherein the schedule indication exposed through the schedule-indication-display aperture is capable of advancement with respect to the dispensing schedule only by completion of a dispensing cycle or by deliberate manual advancement when the cap is removed from the medicine container.

16. The medicine dispenser of claim 14 wherein the schedule display and cap include interoperating features that do not hinder relative rotation of the cap with respect to the schedule display when the cap is rotated in a first direction and that transfer rotational force from the cap to the schedule display when the cap is rotated in a second direction.

17. The medicine dispenser of claim 14 wherein the cap and medicine container include features that interoperate to rotate the schedule display with respect to the cap during each dispensing cycle by a fixed angle equal to 360 degrees divided by the number of schedule-indication positions.

18. The medicine dispenser of claim 17 wherein the features that interoperate to rotate the schedule display with respect to the cap during each dispensing cycle also interoperate to securely latch the cap to the medicine container.

19. The medicine dispenser of claim 14 wherein the schedule display includes manual-manipulation features that allow a user to advance the schedule-indication-display aperture to an initial position within the dispensing schedule.

20. The medicine dispenser of claim 14 wherein the schedule display includes a number of schedule-indication positions equal to 7 multiplied by n, where n is an integer greater than or equal to 1.

* * * * *